US006581997B1

(12) United States Patent
Martikainen et al.

(10) Patent No.: US 6,581,997 B1
(45) Date of Patent: Jun. 24, 2003

(54) CHOPSTICKS

(75) Inventors: Jani Martikainen, Helsinki (FI); Risto Talonpoika, Kuopio (FI)

(73) Assignee: Majamoo Oy, Helsinki (FI)

( * ) Notice: Subject to any disclaimer, the term of this patent is extended or adjusted under 35 U.S.C. 154(b) by 0 days.

(21) Appl. No.: 09/889,864

(22) PCT Filed: Jan. 18, 2000

(86) PCT No.: PCT/FI00/00030

§ 371 (c)(1),
(2), (4) Date: Feb. 1, 2002

(87) PCT Pub. No.: WO00/42889

PCT Pub. Date: Jul. 27, 2000

(65) Prior Publication Data

(65)

(30) Foreign Application Priority Data

Jan. 19, 1999 (FI) ..... 990098
Nov. 25, 1999 (FI) ..... 19992517

(51) Int. Cl.[7] ..... A47G 21/10; A47J 43/28
(52) U.S. Cl. ..... 294/99.2; 294/1.1
(58) Field of Search ..... 294/1.1, 3, 8.5, 294/16, 99.2; 30/123, 142, 150; D7/642, 686

(56) References Cited

U.S. PATENT DOCUMENTS

| | | | | | |
|---|---|---|---|---|---|
| 2,346,537 | A | * | 4/1944 | Fernandez | 294/8.5 |
| 2,561,374 | A | | 7/1951 | Igoe | 30/324 |
| 3,356,405 | A | * | 12/1967 | Gruber | 294/16 |
| 3,596,965 | A | * | 8/1971 | Woofter | 294/28 |
| 4,312,530 | A | | 1/1982 | Young | 294/16 |
| 4,973,095 | A | | 11/1990 | Kunihisa | 294/99.2 |

FOREIGN PATENT DOCUMENTS

| | | | |
|---|---|---|---|
| DE | G 3706456.1 | | 12/1987 |
| DE | 4335907 | A1 | 4/1995 |
| JP | 6022837 | A | 2/1994 |
| WO | WO 97/41762 | | 11/1997 |

* cited by examiner

*Primary Examiner*—Dean J. Kramer
(74) *Attorney, Agent, or Firm*—Lorusso Loud & Kelly LLP

(57) ABSTRACT

Chopsticks formed by two separate chopsticks that during their use are detachably joined to each other, whereby the combination thereof is formed by two blanks called the joint portion blank (1) and the picking portion blank (2). The invention is implemented through having the joint portion blank (1) fabricated by providing at least one of sticks with a notch (3) on which the other stick is superimposed thus allowing the sticks to function as pincer-like pair.

14 Claims, 1 Drawing Sheet

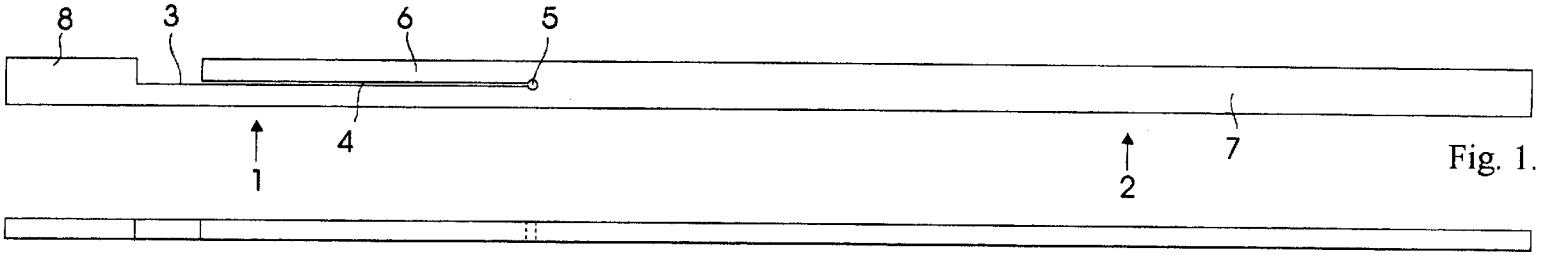
Fig. 1.
Fig. 2.
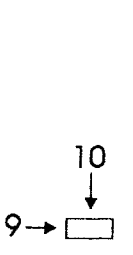
Fig. 3.
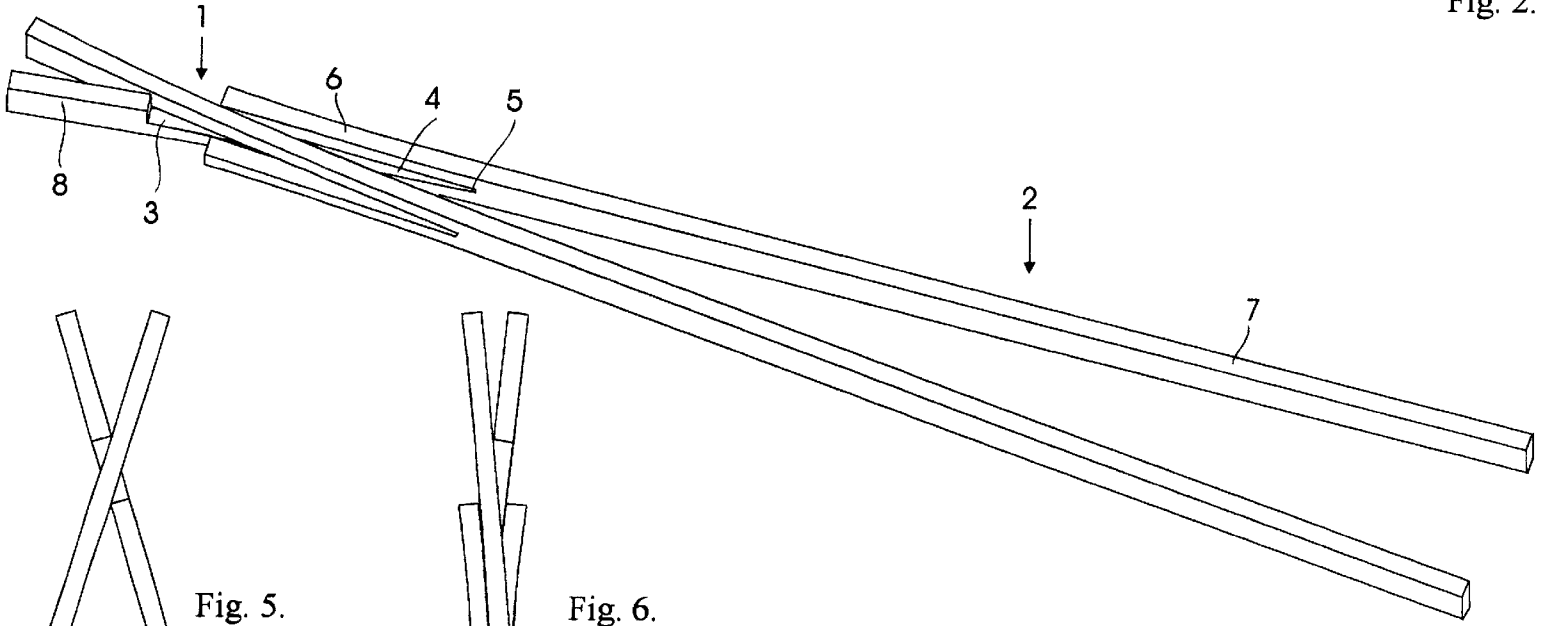
Fig. 4.
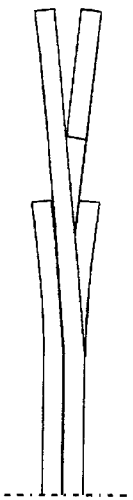
Fig. 6.
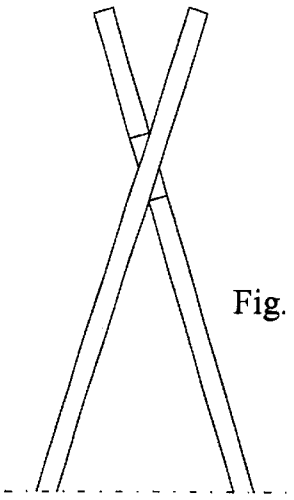
Fig. 5.

CHOPSTICKS

BACKGROUND OF THE INVENTION

The present invention relates to chopsticks or pickers. In the text of this application, the term blank is used for making reference to chopsticks/pickers of different breadth and/or length.

Conventional chopsticks traditionally comprising separate sticks are clumsy to those not skilled in their use. Further, conventional chopsticks/pincers of jointed or permanently fixed type have found limited use or required coupling the sticks to each other by means of a third, additional piece making the technical implementation clumsy and costly (cf. GB Pat. No. 2,288,320A). The embodiment disclosed patent publication PCT/GB97/01206 uses a joint whose structure is limiting to the dimensions of the sticks, makes them wide and disadvantageously dissimilar with each other. The structure of the joint limits the reach offered to the user and weakens the strength of the sticks.

SUMMARY OF THE INVENTION

It is an object of the present invention to provide chopsticks or like utensils that are free from the above-described drawbacks. Chopsticks according to the invention are characterized in that the joint portion blank is fabricated by providing at least one of the sticks with a notch on which the other stick is superimposed thus allowing the sticks to function as a pincer-like pair.

The pivot joint according to the invention facilitates the use of the sticks entirely separately, as a pair of separate sticks in the same manner as conventional chopsticks or, through connecting two sticks by means of the pivot joint to each other, as squeezable pincers that even an unskilled user finds easy to handle. In the pincer position, the picking ends of the sticks open automatically when the squeezing action of fingers is released, thus making it easy to use the jointed chopsticks for eating. The dimensions of the entire stick blank, its joint end and/or its picking end can be varied according to intended use thereby assuring a positive grip with the sticks on pieces and food of different nature and/or dimensions; examples of such pickers being chopsticks, salad tongs and barbecue tongs. The structure and location of the joint are nonlimiting to the shaping of the picking portion of the blanks. Advantageously, the chopstick pair is formed by two blanks having an identical design of the joint portion, wherein other portions of the chopstick pair can be shaped to meet the needs of the intended use without being limited by the design of the joint portion, thus making industrial production of the chopsticks easy and cost-efficient. The structural details of the joint portion allow relatively large manufacturing tolerances. These improvements over the prior art can be attained according to the invention by virtue of a pivot joint that facilitates the connection of two separate blanks into a pincer-like pair, however, without limiting the use of the blanks as two separate pickers in the same fashion as conventional chopsticks or food tongs.

BRIEF DESCRIPTION OF THE DRAWING

In the following, an embodiment of the chopstick according to the invention will be described in more detail with reference to the attached drawings in which FIG. 1 shows a side view of a chopstick;

FIG. 2 shows a top view of the chopstick;

FIG. 3 shows an end view of the chopstick;

FIG. 4 shows two chopsticks assembled into a pincer position;

FIG. 5 shows the pincer connection of the chopsticks released into their open position; and FIG. 6 shows the pincer connection of the chopsticks pressed into their pinching position.

DETAILED DESCRIPTION OF THE INVENTION

The blank (two chopsticks, for instance) is made from a homogeneous material comprising a joint portion 1 and a picking portion 2.

The blank is formed by an elongated stick, rod or plate having a broad side 10 that is the wider side of the blank called the blank breadth and an edge side 9 that is the narrower side of the blank called the blank thickness. The joint portion 1 is formed by a notch 3 machined to the blank from its edge side 9 at such a distance from the blank end that a projection 8 remains at the end of the joint portion 1 of the blank and by a longitudinal slit 4 made into the broad side 10 of the blank, starting from the bottom of the notch 3, perpendicular to the wall thereof, toward the tip of the picking portion 2, whereby a leaf spring 6 is formed. Then, two blanks advantageously having identical shapes of their pivot joint portions 1 can be superimposed at the notches 3 so that the blanks interleave with each other thus forming a pivoting joint that connects the pair of blanks into a pincer-like combination. In the pinching position, the projection 8 of one blank meets the body of the other blank. When pressed into the pinching position, the structure of the joint portion 1 forces the picking portions 2 to meet each other.

The length of the notch 3 determines the mutual position/angle of the blanks when they are joined in their open position (see FIG. 5). Use of the blanks as a pincher-like pair keeps them connected to each other at their opposed ends and pressing the sticks together makes the leaf spring 6 to provide the opening counterforce, whereby releasing the squeezing force causes the picking portions 2 to separate from each other. Thus, the spring mechanism of the pivot joint automatically forces the picking portions 2 squeezed against each other (see FIG. 6) to open when the squeezing force is released.

Squeezing the blanks in their pinching position causes the leaf spring 6 and, the body of the blank at the joint portion 1 to bend in separate directions (see FIG. 6). The longitudinal slit 4 starts from the bottom of the notch 3 and extends in the longitudinal direction of the blank toward the picking portion 2 with a maximally thin gap, whereby in the case that the blank is narrow, the leaf spring 6 and the body of the blank have sufficient thickness to prevent the leaf spring 6 from slipping into the longitudinal slit 4. The depth of the longitudinal slit 4 determines the stiffness of the leaf spring 6 thus controlling the amount of squeezing force required to overcome the opening spring force. The design of the longitudinal slit 4 is capable of preventing splitting of the blank and other breaks in certain materials such as wood. By providing a hole 5 at the end of the longitudinal slit 4 closer to the picking portion 2 or having a rounded shape of the bottom of the longitudinal slit 4, splitting of the blank can be prevented more effective than by using a simple cut to make the longitudinal slit 4. In the use of the blanks as pincers, the blank breadth and the width of the leaf spring 6 eliminate uncontrolled movement of the blanks in the lateral direction.

The uncomplicated structure of the blanks facilitates their industrial manufacture from different kinds of materials including, e.g., wood, metal or polymeric materials. While the blank is made from a homogeneous material without additional components, the joint portion 1 may also be fabricated separately, whereby they must be complemented with separate picking portions 2.

What is claimed is:

1. Chopsticks comprising two sticks each having a joint portion and a picking portion, the sticks being detachably joined to each other during their use, wherein the chopsticks are formed by a joint portion blank and a picking portion blank, wherein the joint portion blank is fabricated by providing each stick with a notch at an essentially identical location having a bottom on which the sticks are superimposed allowing the sticks to function as a pincer-like pair, and wherein at least one stick further comprises a longitudinal slit having a gap and extending from the bottom of the notch toward the picking portion of the stick to form a leaf spring suitable for cooperation with the other stick.

2. The chopsticks according to claim 1, wherein the longitudinal slit has a rounded bottom.

3. The chopsticks according to claim 1, wherein the longitudinal slit defines a hole towards the picking portion of at least one stick, the hole having a diameter larger than the gap of the longitudinal slit.

4. The chopsticks according to claim 1, wherein the sticks are made entirely from the same material.

5. The chopsticks according to claim 1, wherein each stick comprises an essentially identical longitudinal slit.

6. The chopsticks according to claim 5, wherein the longitudinal slit has a rounded bottom.

7. The chopsticks according to claim 5, wherein the longitudinal slit defines a hole towards the picking portion of at least one stick, the hole having a diameter larger than the gap of the longitudinal slit.

8. The chopsticks according to claim 5, wherein the sticks are made entirely from the same material.

9. Chopsticks comprising two sticks each having a joint portion and a picking portion, the sticks being detachably joined to each other during their use, wherein the chopsticks are formed by a joint portion blank and a picking portion blank, wherein the joint portion blank is fabricated by providing at least one of the sticks with a notch having a bottom on which the other stick is superimposed allowing the sticks to function as a pincer-like pair, and wherein each stick further comprises an essentially identical longitudinal slit having a gap and extending from the bottom of the notch toward the picking portion of the stick to form a leaf spring suitable for cooperation with each stick.

10. The chopsticks according to claim 9, wherein the longitudinal slit has a rounded bottom.

11. The chopsticks according to claim 9, wherein the longitudinal slit defines a hole towards the picking portion of at least one stick, the hole having a diameter larger than the gap of the longitudinal slit.

12. The chopsticks according to claim 9, wherein the sticks are made entirely from the same material.

13. Chopsticks comprising two sticks each having a joint portion and a picking portion, the sticks being detachably joined to each other during their use, wherein the chopsticks are formed by a joint portion blank and a picking portion blank, wherein the joint portion blank is fabricated by providing at least one of the sticks with a notch having a bottom on which the other stick is superimposed thus allowing the sticks to function as a pincer-like pair, and wherein at least one stick further comprises a longitudinal slit having a gap and extending from the bottom of the notch toward the picking portion of the stick to form a leaf spring suitable for cooperation with the other stick, the longitudinal slit further defining a hole towards the picking portion, the hole having a diameter larger than the gap.

14. The chopsticks according to claim 13, wherein the sticks are made entirely from the same material.

* * * * *